United States Patent [19]

Nakayama et al.

[11] 4,165,838

[45] Aug. 28, 1979

[54] FUEL INJECTION NOZZLE

[75] Inventors: Kenji Nakayama; Kazuo Uchida, both of Higashi Matsuyama, Japan

[73] Assignee: Diesel Kiki, Co., Ltd., Tokyo, Japan

[21] Appl. No.: 766,300

[22] Filed: Feb. 7, 1977

[30] Foreign Application Priority Data

Feb. 20, 1976 [JP] Japan ..... 51/19063[U]

[51] Int. Cl.[2] ..... B05B 1/30

[52] U.S. Cl. ..... 239/533.3; 239/574

[58] Field of Search ..... 239/574, 533.3–533.12, 239/584

[56] References Cited

U.S. PATENT DOCUMENTS

| | | | |
|---|---|---|---|
| 2,172,383 | 9/1939 | Honn | 239/533.3 X |
| 2,602,703 | 7/1952 | Camner | 239/584 X |
| 3,332,407 | 7/1967 | Scott | 239/533.5 X |
| 3,627,208 | 12/1971 | Scott et al. | 239/533.5 |

*Primary Examiner*—Johnny D. Cherry
*Attorney, Agent, or Firm*—Frank J. Jordan

[57] ABSTRACT

A fuel injection nozzle proper comprises a spring-loaded valve which is opened by fuel pressure in a fuel supply passageway to inject fuel directly into an engine cylinder when the fuel pressure is above a first predetermined value. A check valve is provided in the fuel supply passageway which is opened when the fuel pressure is above a second predetermined value which is higher than the first predetermined value to allow fuel flow through the check valve. A longitudinal passageway having an orifice formed through the check valve element allows fuel flow therethrough even when the fuel pressure is below the second predetermined value so that fuel flows through the check valve to a lesser extent when the check valve is closed than when the check valve is opened so that the fuel flow is constricted and fuel injection is prolonged at low engine speeds thereby reducing combustion noise.

5 Claims, 3 Drawing Figures

FUEL INJECTION NOZZLE

BACKGROUND OF THE INVENTION

The present invention relates to an improved fuel injection nozzle which is adapted to reduce combustion noise in an internal combustion engine during cranking and idle speed operation.

The type of fuel injection nozzle to which the present invention constitutes a novel improvement is provided for each cylinder of an internal combustion engine such as a Diesel engine. A fuel injection or metering pump of the distribution type feeds fuel to the injection nozzle at the correct timing in the engine operating cycle and in the correct amount. This type of injection nozzle generally comprises a spring-loaded valve which is normally closed and is opened when the fuel pressure from the pump exceeds a predetermined value to discharge fuel from an injection or discharge orifice of the nozzle into the engine cylinder.

A problem has existed in the art thus far in that fuel injection is excessively fast under low speed operating conditions such as cranking and idling. This results in overly rapid combustion and excessive combustion noise.

U.S. Pat. No. 3,559,892 to De Luca discloses a fuel injection nozzle of the present general type and means for improving combustion at low speed. Said means comprise an auxiliary fuel discharge orifice of small diameter which is uncovered for fuel injection when the fuel pressure is above a first predetermined value and a main fuel injection orifice of larger diameter which is also uncovered when the fuel pressure is above a second predetermined value which is higher than the first predetermined value. Whereas De Luca's disclosure constitutes a valuable contribution to the art, it is particularly directed to engines in which fuel is sprayed on the piston cavity wall and is difficult to incorporate into other types of engines.

SUMMARY OF THE INVENTION

The present invention provides a fuel injection nozzle proper comprising a spring-loaded valve which is opened by fuel pressure in a fuel supply passageway leading from a metering pump to inject fuel directly into an engine cylinder when the fuel pressure is above a first predetermined value. A check valve is provided in the fuel supply passageway which is opened when the fuel pressure is above a second predetermined value which is higher than the first predetermined value to allow fuel flow through the check valve. A longitudinal passageway having an orifice formed through the check valve element allows fuel flow therethrough even when the fuel pressure is below the second predetermined value so that fuel flows through the check valve to a lesser extent when the check valve is closed than when the check valve is opened so that fuel flow is constricted and fuel injection is prolonged at low engine speeds.

It is an object of the present invention to provide a fuel injection nozzle which reduces combustion noise under low speed engine operating conditions.

It is another object of the present invention to provide a generally improved fuel injection nozzle.

Other objects, together with the foregoing, are attained in the embodiment described in the following description and illustrated in the accompanying drawings.

DESCRIPTION OF THE PREFERRED EMBODIMENT

While the fuel injection nozzle of the invention is susceptible of numerous physical embodiments, depending upon the environment and requirements of use, substantial numbers of the herein shown and described embodiment have been made, tested and used, and all have performed in an eminently satisfactory manner.

Figure 1:
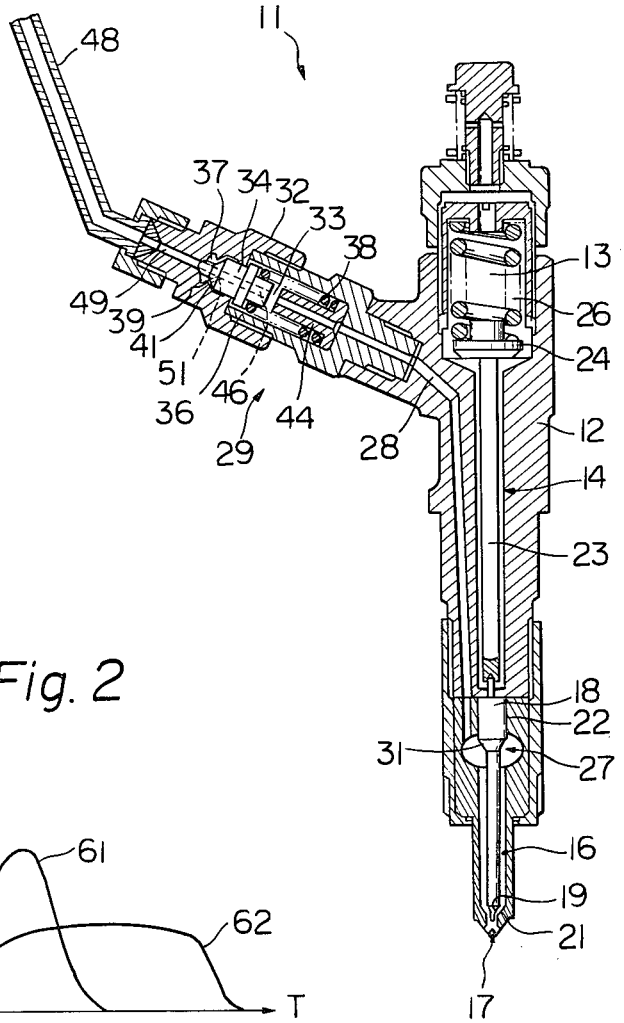
FIG. 1 is a vertical section of a fuel injection nozzle embodying the present invention.

Referring now to FIG. 1 of the drawing, a fuel injection nozzle embodying the present invention is generally designated by the reference numeral 11 and comprises a nozzle body 12. The nozzle body 12 is formed with a longitudinal bore of varying diameter which defines a spring chamber 13, a spindle chamber 14 and a valve chamber 16. The lower end of the valve chamber 16 opens into the cylinder of an internal combustion engine (not shown) through a fuel discharge orifice 17. A valve element 18 is formed with a lower most conical portion 19 which is adapted to sealingly engage with a valve seat 21 through which the discharge orifice 17 is formed to block the same.

The valve element 18 is sealingly slidingly fitted in the nozzle body 12 at 22 to seal the valve chamber 16 from the spindle chamber 14. The upper end of the valve element 18 is connected to an upwardly extending spindle 23 which is formed at its upper end with a spring seat 24. A compression type valve spring 26 engages with the spring seat 24 and thereby urges the spindle 23 and valve element 18 downwardly so that the conical portion 19 of the valve element 18 normally sealingly engages with the valve seat 21.

The valve chamber 16 is larger in diameter than the valve element 18 and terminates at its upper end in a fuel chamber 27. The downstream section 28 of a fuel supply passageway 29 opens into the fuel chamber 27. The valve element 18 is further formed with a tapered portion 31 which is configured so that fuel pressure in the downstream section 28 and thereby the fuel chamber 27 urges the valve element 18 and spindle 23 upwardly against the force of the valve spring 26. The valve element 18 is actually moved upwardly to communicate the fuel chamber 27 with the discharge orifice 17 through the valve chamber 16 when the fuel pressure in the fuel chamber 27 is above a first predetermined value which is sufficient to overcome the preload of the valve spring 26.

More specifically, the downstream section 28 is connected as will be described in detail below to a fuel metering or injection pump (not shown) which positively displaces fuel into the downstream section 28 at the proper timing in the engine cycle. The amount of fuel depends on the engine load and the desired engine speed. As the pressure rises in the fuel chamber 27, the valve element 18 is moved to unblock the discharge orifice 17 and allow the fuel to be injected into the engine cylinder. Fuel injection continues as long as the injection pump maintains sufficient fuel pressure in the fuel chamber 27 to hold the valve element 18 disengaged from the valve seat 21.

The fuel injection nozzle of the invention further comprises a block 32 which is screwed to the nozzle body 12 and extends therefrom at an angle. The block 32 is formed with a spring chamber 33 in which is slidably received a valve element 34 of a check valve 36. The block 32 is further formed with a fuel chamber 37, with the valve element 34 slidably received in the block 32 in such a manner as to seal the spring chamber 33 from the fuel chamber 37. A compression type valve spring 38 is provided in the spring chamber 33 to urge the valve element 34 leftwardly so that a conical portion 39 engages with a valve seat 41 formed in the block 32. A stop 44 is provided in the spring chamber 33 to limit movement of the valve element 34 and the downstream section 28 of the fuel supply passageway 29 extends longitudinally through the stop 44 into the spring chamber 33.

The valve element 34 is formed with a longitudinal passageway 46 having an orifice **46*a* completely therethrough. An upstream portion 49 of the fuel supply passageway 29 leads from the fuel chamber 37 through the block 32 and a pipe 48** to the injection pump, although this connection is not shown.

The valve element 34 is further formed with a connecting passageway 51 which leads from the longitudinal passageway 46 to the conical portion 39. The opening of the connecting passageway 51 is connected to the fuel chamber 37. When the fuel pressure in the upstream section 49 is above a second predetermined value which is higher than the first predetermined value, the valve element 34 is moved away from the valve seat 41 thereby against the force of the valve spring 38 to allow fuel flow from the upstream section 49 to the downstream section 28 through the fuel chamber 37, connecting passageway 51 and longitudinal passageway 46 and through the orifice **46*a* of the longitudinal passageway 46**.

With the fuel pressure from the fuel injection pump in the fuel supply passageway 29 below the first predetermined value, the valve element 18 will seat and prevent fuel from being discharged into the engine through the discharge orifice 17. When this pressure exceeds the first predetermined value, the valve element 18 is unseated and fuel flows through the upstream section 49, the orifice **46*a* of the longitudinal passageway 46 in the valve element 34, the spring chamber 33, the downstream section 28, the fuel chamber 27 and valve chamber 16 to the discharge orifice 17** from which it is discharged into the engine cylinder.

Since higher fuel pressures are associated with high engine speed demands, the fuel pressure will only exceed the second predetermined value when the engine speed demanded is above the cranking or low idle speed range. When this condition occurs, the valve element 34 is unseated and fuel flows through the connecting passageway 51 to the fuel discharge orifice 17.

It will be understood that two intermediate sections of the fuel supply passageway 29 are provided, although not designated by reference numerals. The first intermediate section comprises the fuel chamber 37 and connecting passageway 51. The second intermediate section is constituted by the portion of the longitudinal passageway 46 including the orifice **46*a* upstream of the junction with the connecting passageway 51. The portion of the longitudinal passageway 46 downstream of the junction with the connecting passageway 51 is actually part of the downstream section 28. It will be seen that the first and second intermediate sections each connect at opposite ends thereof with the upstream and downstream sections 49 and 28 respectively and constitute intermediate branches of the fuel supply passageway 29 with the valve element 34 of the check valve 36** forming part of the first and second intermediate sections.

The diameters of the passageways 46 and 51 are designed so that, with the check valve 36 opened, the fuel flow through the passageways 46 and 51 is sufficient for the highest engine speed of which the associated engine is capable. When the engine speed is low such that the check valve 36 is closed and fuel flow is only through the longitudinal passageway 46 including the orifice **46*a*, it will be seen that the fuel supply passageway 29** is constricted.

Figure 2:
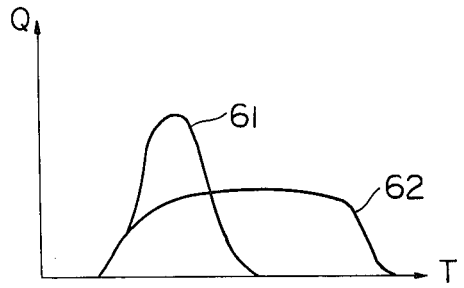
FIG. 2 is a graph illustrating the operation of the present fuel injection nozzle compared to the prior art.
Figure 1A:
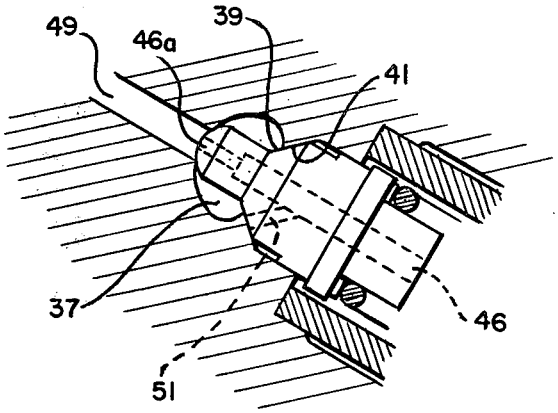
FIG. 1A is a partial enlarged view of FIG. 1.

The advantage of this arrangement is illustrated in FIG. 2, in which a curve 61 illustrates the performance of prior art fuel injection nozzles and a curve 62 illustrates the improved performance provided by the present invention, both curves representing the same low idling speed operation. The ordinate axis represents the instantaneous rate of fuel injection into the engine, designated as Q, and the abscissa axis represents time T.

With conventional fuel injection nozzles in which the fuel supply passageway is unconstricted at all times (equivalent to holding the present check valve 36 open at all times), fuel injection occurs very quickly after the valve element 18 is unseated as is clear from the curve 61. This fuel which is so rapidly injected into the engine is combusted almost instantaneously so as to constitute an explosive rather than a burning process. The result is excessive shock to the engine which gives rise to an unnecessarily high noise level of operation and also contributes to premature engine breakdown.

This problem is overcome by the present invention as evidenced by the curve 62. Whereas the same amount of fuel is injected into the engine, the rate of fuel injection is decreased (fuel injection is prolonged) due to the constriction of the fuel supply passageway 29 which results when the fuel pressure is between the first and second predetermined values and the check valve 36 is closed. This slower rate of fuel injection and combustion substantially reduces the engine operating noise level and prolongs the service life of the engine. The present invention is not only adaptable to engines in which fuel is sprayed on the piston cavity wall but is adaptable with equal ease to engines in which fuel is sprayed into the cumbustion chamber as a mist.

Many modifications will become possible for those skilled in the art after receiving the teachings of the present disclosure without departing from the scope thereof. A typical such modification is to form the second intermediate section of the fuel supply passageway 29 through the block 32 rather than through the valve element 34.

What is claimed is:

1. A fuel injection nozzle comprising:

a fuel supply passageway having an upstream section, a downstream section and first and second intermediate sections, each of the first and second intermediate sections being connected at opposite ends thereof to the upstream section and the downstream section respectively;

fuel discharge orifice means;

a fuel discharge valve exposed to fuel pressure in the downstream section and being opened thereby to communicate the downstream section with the fuel discharge orifice means only when the fuel pressure in the downstream section is above a first predetermined value; and a check valve forming part of the first and second intermediate sections, the check valve being exposed to fuel pressure in the upstream section and being opened thereby to allow fuel flow through both of the first and second intermediate sections when the fuel pressure in the upstream section is above a second predetermined value which is higher than the first predetermined value.

2. A fuel injection nozzle as in claim 1, in which the fuel discharge valve comprises a valve seat, a valve element and a valve spring, the valve spring urging the valve element to engage with the valve seat and block communication between the downstream section and the fuel discharge orifice means, the valve element being movable by the fuel pressure in the downstream section against the force of the valve spring to disengage from the valve seat and establish communication between the downstream section and the fuel discharge orifice means.

3. A fuel injection nozzle as in claim 1, in which the check valve comprises a valve seat, a valve element and a valve spring urging the valve element to engage with the valve seat and block fuel flow through the first intermediate section, the valve element being movable by the fuel pressure in the upstream section against the force of the valve spring to disengage from the valve seat and allow fuel flow through the first intermediate section.

4. A fuel injection nozzle as in claim 3, in which the second intermediate section is constituted by a longitudinal passageway having an orifice formed through the valve element.

5. A fuel injection nozzle as in claim 4, further comprising a fuel chamber communicating with the upstream section, the first intermediate section comprising the fuel chamber and a connecting passageway formed through the valve element and communicating with the longitudinal passageway.

* * * * *